US005613623A

United States Patent [19]

Hildebrandt

[11] Patent Number: 5,613,623

[45] Date of Patent: Mar. 25, 1997

[54] TWO-CHAMBER CONTAINER

[75] Inventor: Bodo Hildebrandt, Riedstadt, Germany

[73] Assignee: Wella Aktiengesellschaft, Darmstadt, Germany

[21] Appl. No.: 504,012

[22] Filed: Jul. 19, 1995

[30] Foreign Application Priority Data

Sep. 9, 1994 [DE] Germany ..... 44 28 096.3

[51] Int. Cl.[6] ..... B67D 5/56

[52] U.S. Cl. ..... 222/129; 206/221

[58] Field of Search ..... 222/80, 129, 145.1; 604/82, 83, 87, 89, 91, 92; 215/DIG. 8; 206/220, 221, 222

[56] References Cited

U.S. PATENT DOCUMENTS

| | | | |
|---|---|---|---|
| 2,813,649 | 11/1957 | Lipari | 206/221 X |
| 3,024,947 | 3/1962 | Jeynes, Jr. | 206/222 X |
| 3,651,990 | 3/1972 | Cernei | 206/221 X |
| 4,203,517 | 5/1980 | Hildebrandt et al. | 206/221 |
| 4,936,446 | 6/1990 | Lataix | 206/221 |
| 5,417,321 | 5/1995 | Halm | 206/221 |

FOREIGN PATENT DOCUMENTS

| | | | |
|---|---|---|---|
| 500073 | 12/1950 | France | 206/221 |
| 2663304 | 12/1991 | France | 206/221 |
| 8900291 | 6/1990 | Germany . | |

*Primary Examiner*—Andres Kashnikow
*Assistant Examiner*—Kenneth Bomberg
*Attorney, Agent, or Firm*—Michael J. Striker

[57] ABSTRACT

A two-chamber container for accommodating flowable substances separately from one another has an upper chamber and a lower chamber, a reduced diameter bottle which separates the chambers from one another and is provided with a plug in a plane of the reduced diameter, a rotary cap provided with a plunger and turnable so that the plunger is pressed from the plane of the reduced diameter into the lower chamber so as to bring both substances together. The rotary cap has a thread in the upper chamber, while the plunger has a threaded portion engaged in the thread of the rotary cap. The plunger is formed as a tubular plunger which has a first end and a second end formed so that in a base position the first end of the plunger is connected with the threaded portion of the plunger in fluid-tight manner and the second end of the plunger extends through the plug into the lower chamber, and the plunger is connected with the plug in fluid-tight manner.

7 Claims, 3 Drawing Sheets

TWO-CHAMBER CONTAINER

BACKGROUND OF THE INVENTION

The present invention relates generally two-chamber containers.

More particularly, it relates to two-chamber containers in which separation of upper and lower chambers is performed by a reduced diameter bottle with a plug in a reduced diameter plane.

Such containers are known generally in the art. One of such containers is disclosed for example in the German patent document DE-U-89 00 291 of the applicant. This container is used for storing two different liquid products separately before their utilization. In order to be used later on, the products are brought together to provide a mixture which is then removed through a lock. It is believed that the above mentioned container can be further improved.

SUMMARY OF THE INVENTION

It is therefore an object of the present invention to provide a two-chamber container of the above mentioned general type, which is a further improvement of the known container.

More particularly it is an object of the present invention to provide the container of the above mentioned general type which is designed so that a simple handling is possible, and also it is possible to withdraw a limited partial quantity of only one of the products stored in the container.

In keeping with these objects and with others which will become apparent hereinafter, one feature of the present invention resides, briefly stated, in a two-chamber container which has a reduced diameter bottle separating upper and lower chambers and having a plug in a reduced diameter plane, a rotary cap which is manually turnable for bringing both substances inside the container together and a plunger provided for pressing the same from the reduced diameter plane into the lower chamber and having a threaded portion engageable in a thread of the rotary cap in the upper chamber, wherein in accordance with the present invention the plunger is formed as a tubular plunger, in a base position the first end of the plunger is connected with the threaded portion of the plunger in a fluid-tight manner while a second end of the plunger extends through the plug into the lower chamber, and the plunger is connected with the plug in fluid-tight manner.

Since the plunger is tubular and in the base position is connected with its first end with the threaded portion in a fluid-tight manner and extends with its second end through the plug into the lower chamber, and also the plunger is connected with the plug in the fluid-tight manner, a limited partial quantity of only one product can be withdrawn from the lower chamber. Such a construction can be used for example in hair salons for discharging only one product in a limited quantity for a first hair treatment step. In order to perform a second hair treatment step with a product mixture, the cap is turned, the container is briefly shaken and then the product mixture is applied onto the hair.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
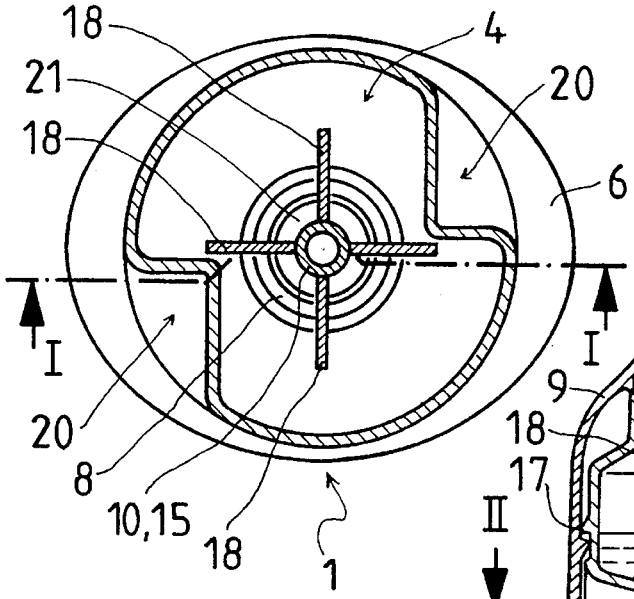
FIG. 2 is a view showing a section taken along the line II—II in FIG. 1.
Figure 1:
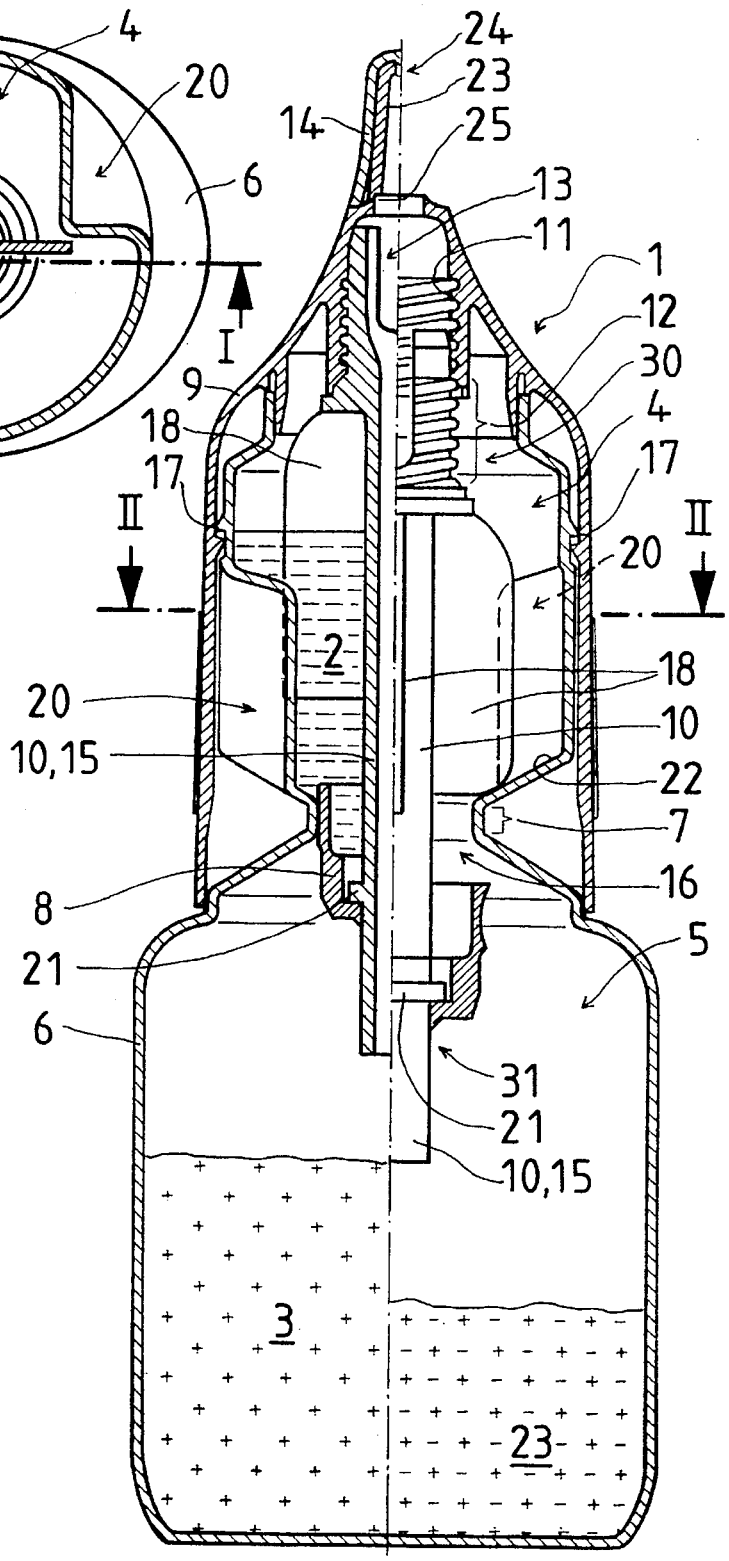
FIG. 1 is a view showing an axial section of a two-chamber container in accordance with a first embodiment of the present invention.

A two-chamber container 1 in accordance with the first embodiment is shown in FIG. 1. The container is used for separate storing of flowable substances 2 and 3. For this purpose a container 1 has upper and lower chambers 4 and 5 which are separated from one another by a bottle 6 with a reduced diameter portion and a plug 8 arranged in a plane 7 of the reduced diameter portion. For bringing together the substances 2 and 3 in the container 1, the plug 8 is pressed downwardly from the plane 7 into the lower chamber 5 by a plunger 10 under the action of manual rotation of a rotary cap 9. For this purpose the rotary cap 9 has a thread 11 in the upper chamber 4, and a threaded portion 12 arranged on the plunger 10 engages in the thread 11 of the rotary cap 9 similarly to a spindle drive.

Throughgoing openings 13 are provided in the end region of the threaded portion 12 for passage of a mixture of the substances 2 and 3. For withdrawal of the substances 2, 3, the rotary cap 9 is provided with a closure 14. The plunger 10 is formed as a tubular plunger. In a base position its first end 30 is connected with the threaded portion 12 in fluid-tight manner, and its other second end 31 extends through the plug 8 into the lower chamber 5. The plunger 10 is connected with the plug 8 in fluid-tight manner.

The left side of FIG. 1 shows the container 1 in a storage position or in other words before the withdrawal of the substances 2, 3. The right side of FIG. 1 shows the container 1 with the plug 8 pressed into the lower chamber 5 and with a mixture of the substances 2, 3 wherein a part of the substance 3 has been already withdrawn through a pipe 15 extending into the chamber 5. Four radially arranged vanes 18 are formed on the pipe 15. The upper chamber 4 is provided with two opposite receptacles 20, 20A which together with the vanes 18 form a sliding bearing or a rotary securing for the plunger 10 in form of a spindle drive of the plunger 10.

For filling the container 1, first the lower chamber 5 with the reduced diameter bottle 6 is filled a liquid substance 3 without the rotary cap 9 and the plunger 10/plug 8 through an opening 16. Then the plug 8 together with the plunge 10 is pressed into the opening 16. For this purpose the tubular plunger 10 is provided with a driver ring 21 which is dimensioned so that the plug 8 can be pressed by the axial force of the plunger 10 in the seat of the reduced diameter opening 16. After filling of the upper chamber 4 with the substance 2, the cap 9 is turned onto the threaded portion 12 and abuts against the arresting ring 17.

For withdrawing a partial quantity, the lock 14 is open and a limited quantity of the substance 3 is withdrawn through the predetermined length of the pipe 15. For further withdrawal of a mixture of the substances 2, 3 they are first brought together by turning of the cap 9 of the driver ring 21, so that the plug 8 is pressed downwardly into the lower chamber 5 and the substance 2 flows from the upper chamber 4 through the released opening 16 into the lower chamber 5 to form a mixture of the substances 2, 3 by shaking of the container 1.

The advantageous feature of this embodiment is that the plug can be composed of a material which is especially suitable for sealing purposes. The end of the process of separation of the chamber is signalled by the fact that the lower end of the vanes 18 is pressed against a bottom 22 of the upper chamber 4 and thereby a further rotation of the cap 9 is prevented (as can be seen from the right side of FIG. 1). In the practical use the substances 2, 3 are thickened during the mixing process. In order to facilitate withdrawal of the thickened mixture of the substances 2, 3, the closure part 23 with its relatively small opening 24 can be broken by a braking ring 25 so as to provide a greater withdrawal opening 26.

Figure 3:
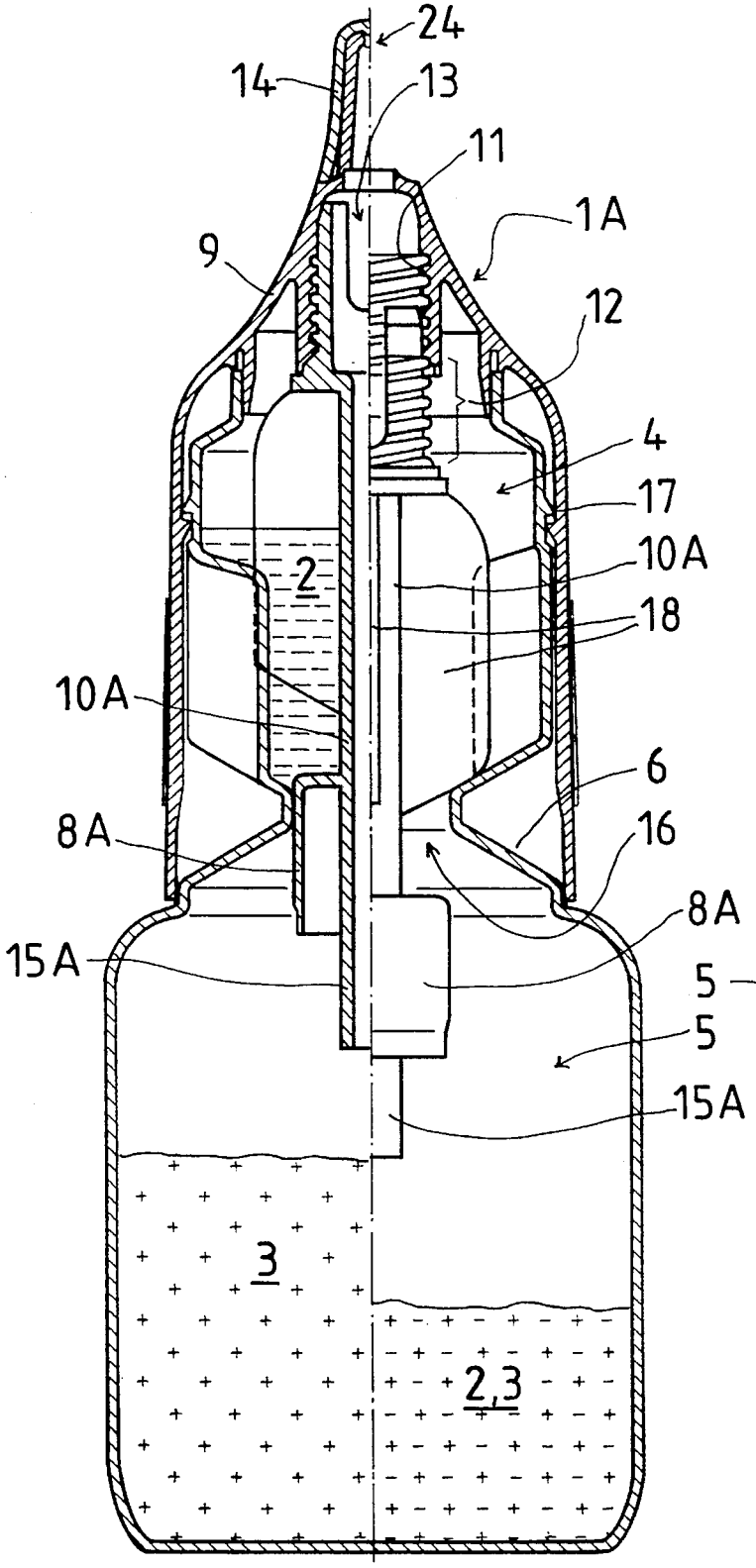
FIGS. 3 and 4 are views showing axial sections of a two-chamber container in accordance with a second embodiment of the present invention.
Figure 4:
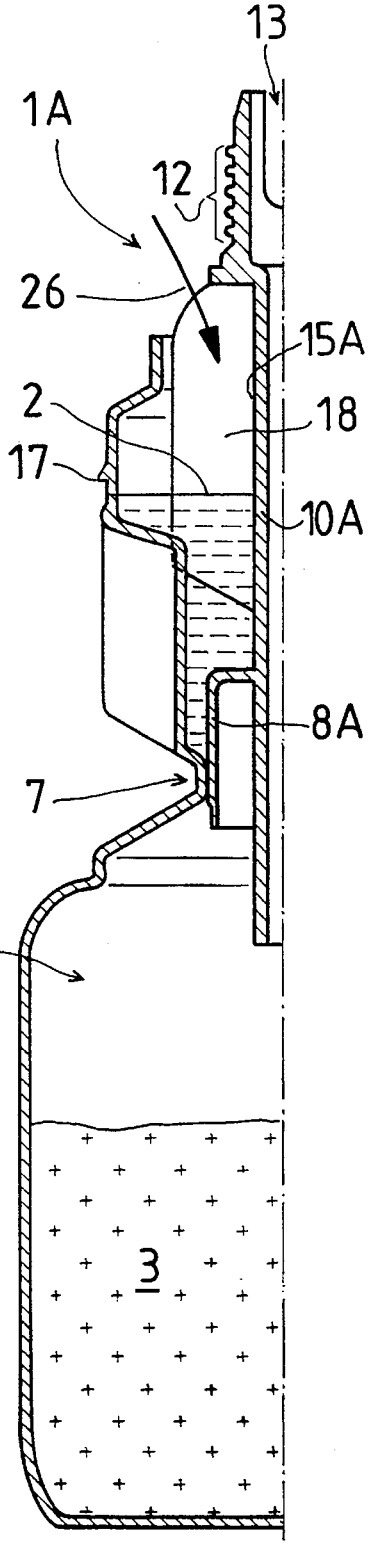

In a container 1A formed in accordance with the second embodiment as shown in FIGS. 3 and 4, the plunger 10A and the plug 8A are formed as a single one-piece element and therefore this element is reduced. The left side of FIG. 3 shows the container 1A in a storage position or in other words before its use. The right side of FIG. 3 shows the container 1A when the chambers are no longer separated.

FIG. 4 shows the container 1A of FIG. 3 in a position immediately before filling of both substances 2 and 3. The container 1 is without the rotary cap 9 and the plug 8A is in its high closure position. The filling of the lower chamber 5 with a substance 3 can be performed through the opening 6 and after placing the plug 8A the filling of the upper chamber 4 with a substance 2 is performed through the freely located vanes 18 as identified with the arrow 26. However, also a simultaneous filling in accordance with FIG. 4 can also be provided, namely the simultaneous filling of the lower chamber 5 through the pipe 15A and the upper chamber 4 in accordance with the arrow 26. After the filling process, the cap 9 is turned on the threaded portion 12 and then forced on the arresting ring 17. This forcing step requires a certain axial stroke of the plug 8A, and therefore the plug 8A must have a corresponding long design because of the sealing function.

Figure 5:
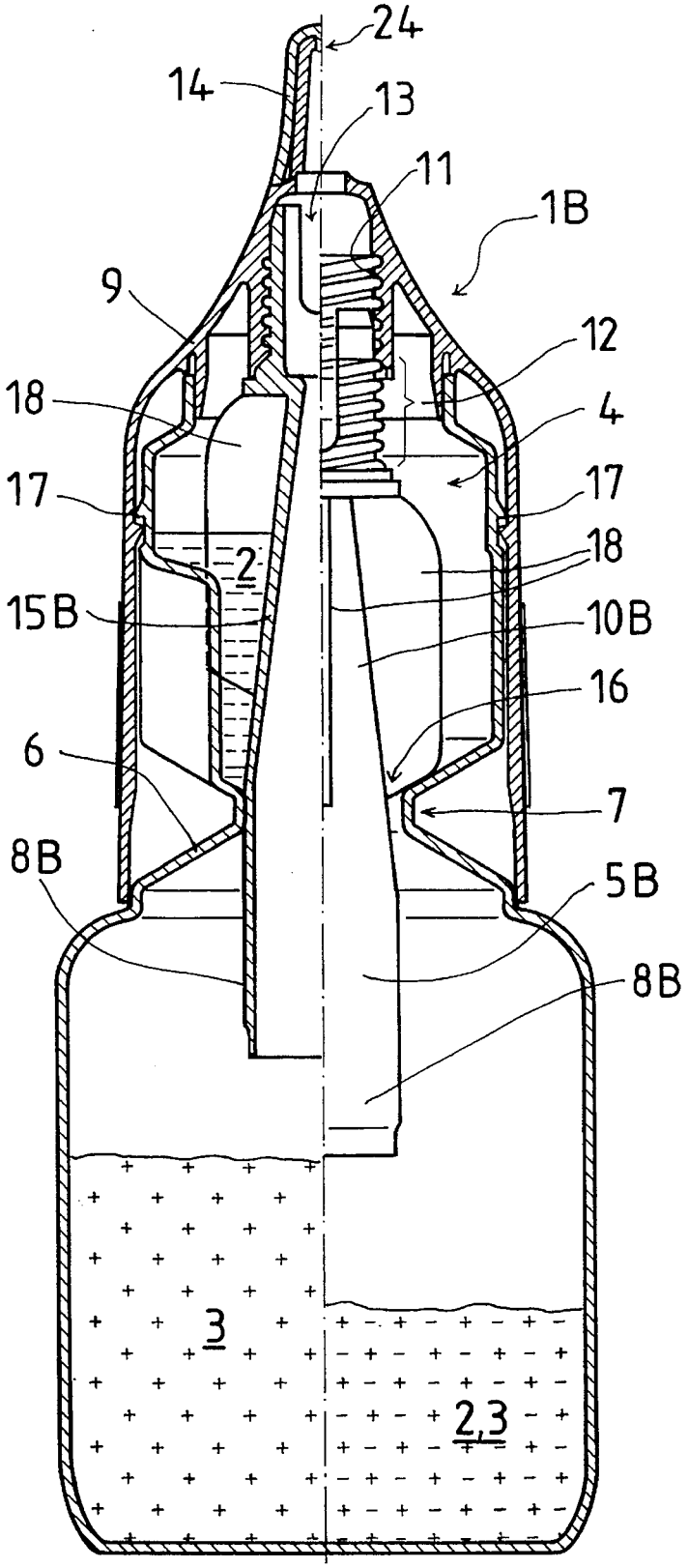
FIGS. 5 and 6 are views showing axial sections of a two-chamber container in accordance with a third embodiment of the present invention.
Figure 6:
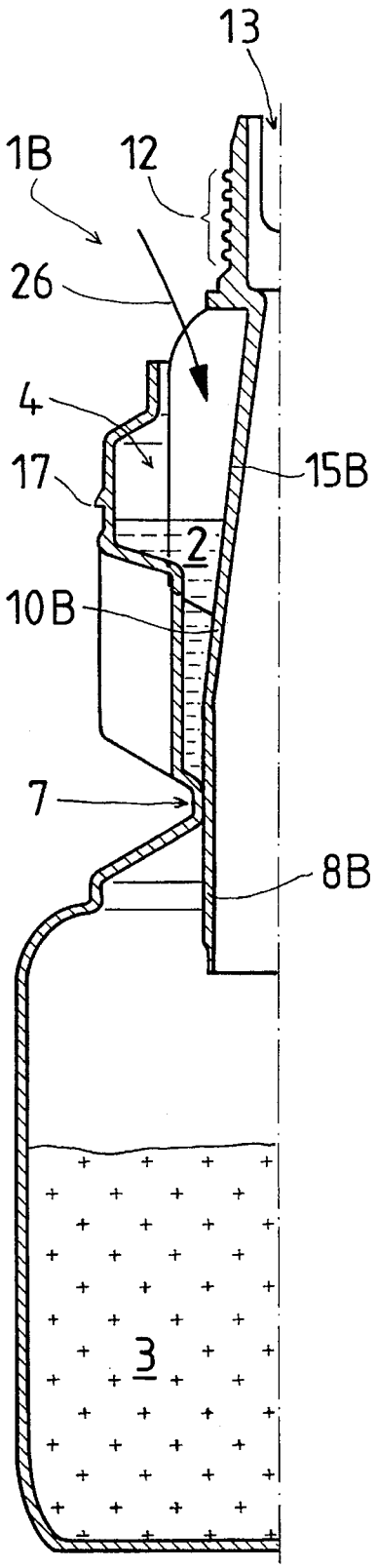

In a container 1B in accordance with the third embodiment shown in FIGS. 5 and 6, the plunger 10B is formed as an elongated plug 8B. The plug 8B therefore simultaneously operates as the pipe 15B. In other aspects, this container is the same as the containers of the previous embodiments.

It will be understood that each of the elements described above, or two or more together, may also find a useful application in other types of constructions differing from the types described above.

While the invention has been illustrated and described as embodied in a two-chamber container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A two-chamber container for accommodating flowable substances separately from one another, comprising means for forming an upper chamber and a lower chamber, said means including a reduced diameter bottle which separates said chambers from one another and is provided with a plug in a plane of a reduced diameter; a rotary cap provided with a plunger and turnable so that said plunger is pressed from the plane of the reduced diameter into said lower chamber so as to bring both substances together, said rotary cap having a thread in said upper chamber, while said plunger having a threaded portion engaged in said thread of said rotary cap, said plunger being formed as a tubular plunger which has a first end and a second end formed so that in a base position said first end of said plunger is connected with said threaded portion of said plunger in fluid-tight manner and said second end of said plunger extends through said plug into said lower chamber, said plunger being connected with said plug in fluid-tight manner.

2. A two-chamber container as defined in claim 1, wherein said threaded portion of said plunger has an end region provided with throughgoing openings, and said rotary cap is provided with .a closure for withdrawal of the substances.

3. A two-chamber container as defined in claim 1, wherein said tubular plunger has a pipe provided with said second end, said plug being axially displaceable on said second end of said pipe, said pipe being also provided with a driver ring which forms an axial abutment for said plug.

4. A two-chamber container as defined in claim 1, wherein said plug and said plunger are formed as a one-piece element.

5. A two-chamber container as defined in claim 1, wherein said plug is elongated in an axial direction, said plunger being formed as said elongated plug.

6. A two-chamber container as defined in claim 1, wherein said plunger has radially extending vanes, said upper chamber having a wall provided with receptacles formed so that during turning of said cap said vanes engage in said receptacles.

7. A two-chamber container as defined in claim 1, wherein said thread of said rotary cap is formed as an inner thread, said threaded portion of said plunger being formed as an outer side engaged with said inner thread of said rotary cap.

* * * * *